US005412917A

United States Patent [19]

Shelton

[11] Patent Number: 5,412,917

[45] Date of Patent: May 9, 1995

[54] FIXED RESILIENT SLEEPER ATHLETIC FLOORING SYSTEM

[76] Inventor: Floyd Shelton, 803 Jefferson St., Wausau, Wis. 54401

[21] Appl. No.: 135,540

[22] Filed: Oct. 14, 1993

[51] Int. Cl.[6] ..... E04F 15/22

[52] U.S. Cl. ..... 52/403.1; 52/393; 52/480; 52/508

[58] Field of Search ..... 52/403.1, 480, 508, 52/393

[56] References Cited

U.S. PATENT DOCUMENTS

| | | | |
|---|---|---|---|
| 498,344 | 5/1893 | Williams | 52/403.1 |
| 1,787,067 | 12/1930 | Eisler | 52/480 |
| 4,860,516 | 8/1989 | Koller et al. | 52/480 |
| 4,879,857 | 11/1989 | Peterson et al. | 52/480 X |
| 5,277,010 | 1/1994 | Stephenson et al. | 52/480 X |
| 5,299,401 | 4/1994 | Shelton | 52/480 X |
| 5,303,526 | 4/1994 | Niese | 52/480 X |

FOREIGN PATENT DOCUMENTS

| | | | |
|---|---|---|---|
| 1201226 | 8/1970 | United Kingdom | 52/403.1 |

*Primary Examiner*—Carl D. Friedman
*Assistant Examiner*—Kevin D. Wilkens
*Attorney, Agent, or Firm*—Russell L. Johnson

[57] ABSTRACT

An athletic flooring system having a fixed resilient sleeper. Sleeve members are passed through bored holes in the sleeper and anchored to a base so as to restrict the horizontal movement of the sleeper while permitting the sleeper to flex resiliently in the vertical direction. The flexibility of the sleeper is further enhanced by the provision of transverse saw kerfs cut into the top and bottom surfaces of the sleeper.

8 Claims, 2 Drawing Sheets

FIXED RESILIENT SLEEPER ATHLETIC FLOORING SYSTEM

FIELD

This invention relates to the fixed sleeper type of athletic flooring systems.

BACKGROUND

Athletic flooring systems can be divided into two types; the floating type which rest upon resilient pads and is not attached to a base, and the fixed type which is anchored to the base and is usually supported by sleepers. With the floating type of system, the floor has desirable resiliency properties, but is capable of considerable horizontal displacement over time. With the fixed type of system the resilience of the floor is reduced but the floor is restrained from appreciable horizontal displacement.

In recent years a DIN system of rating athletic floors in point and area elasticity, ball rebound, and rolling load characteristics, to set standards of performance for athletic floors has been widely accepted in the flooring industry.

A detailed explanation of the testing that goes into the DIN certification process is found in a paper titled; Din 18032, Part 2, (March 1991); SPORTS HALLS; HALLS FOR GYMNASTICS AND SPORTS GAMES SPORTS SURFACES; REQUIREMENTS; TESTING, as translated from the German, by Hans J. Kolitzus 1ST/USSL April 1992.

Acquiring certification under the DIN 18032 Part 2 requirements involves a series of tests and measurements done by a certified tester, under specified conditions, using specified methods and equipment.

For each of the categories of tests a specified number of measurements are taken and the results computed and averaged. The average result for each category of test must then meet the requirements for DIN certification in that category.

Force Attenuation is a measure of the force reduction achieved by a test floor as a percent of the force reduction achieved by a standardized rigid floor (steel over cement on compacted earth). The DIN test involves a dropped test weight acting through a spring loaded force transfer instrument. The force reduction is computed as a percent as; $(1-F_{max\ test}/F_{max\ stand.})\times 100$. For certification that value must be a minimum of 58%.

Standard Deformation is a measure of the vertical displacement of a test floor in response the impact of a dropped weight, measured at the location of the dropped weight on the test floor. Standard deformation is measured in millimeters and is computed by a formula that contains correction factors. For DIN certification, the computed standard deformation must be between 3.0 mm. minimum, and 5.0 mm. maximum.

Deformation Trough is a measure of vertical displacement of a test floor at 500 mm. from the location of impact of a draped weight. Deformation trough is computed as a percentage of the displacement of the floor at the location of impact. A maximum percentage of 5% is permitted for DIN certification.

Rolling Load is a measure of the effects of a weighted test wheel which is rolled over defined strips on the test floor a prescribed number of times (300 passes). The test floor is then cut up and examined. For DIN certification, no damage to the floor or its substructure can be found and any remaining impressions must be less than 0.5 mm.

Ball Rebound is a measure of the rebound of a standardized basketball dropped from a set height on a test floor and is computed as a percentage of the rebound of the basketball from a rigid floor. For DIN certification, the percentage must be a minimum of 90%.

The DIN test contains other measures such as, Sliding Coefficient, which are concerned with properties other than those significantly influenced by the flooring system of this invention.

To date no fixed sleeper system known to the inventor has been found to be DIN certifiable.

OBJECTS

It is therefore and object of this invention to provide an athletic flooring system of the fixed resilient sleeper type in which the system exhibits the horizontal stability associated with fixed sleeper systems and the vertical resilience commonly associated with floating systems.

It is further an object of this invention to modify the sleeper and its supports, in such a way that a flooring system employing the sleeper is capable of achieving a DIN certification.

FIG. 5 is a sectioned elevational fragmentary view illustrating the sleeve member of this invention passing through the pad member of this invention.

PRIOR ART

Fixed sleeper athletic flooring systems are old in the art.

U.S. Pat. No. 4,856,250 to Gronau teaches a flooring system which confines a sleeper within a C-shaped channel so that the sleeper is free to slide longitudinally of the channel while being restrained in the directions transverse to the channel.

The inventor knows of no prior art fixed resilient sleepers.

U.S. Pat. No. 4,890,434 to Niese, is of interest in that it provides a table at the top of column 9 that sets out some of the criteria needed to achieve DIN certification. In claim 21, Niese recites values for some of these criteria in claiming novelty for his flooring system.

BRIEF DESCRIPTION OF THE INVENTION

The invention is for a fixed resilient sleeper athletic flooring system. The system employs a fixed sleeper which has been critically modified so as to give the system the horizontal stability of a fixed sleeper system while at the same time providing the vertical resilience commonly associated with a floating system. The critical modifications being, to provide a sleeve member which is anchored to the flooring base and upon which the sleeper can flex vertically, and to further provide discrete resilient pads secured to the bottom of the sleeper so as to provide the desired amount of resistance to and yield to, loads on the floor above, and to further provide the sleeper with transverse saw kerfs regularly spaced and alternately cut in the top and bottom surfaces of the sleeper to add resilience and flex to the sleeper.

DETAILED DESCRIPTION

Figure 1:
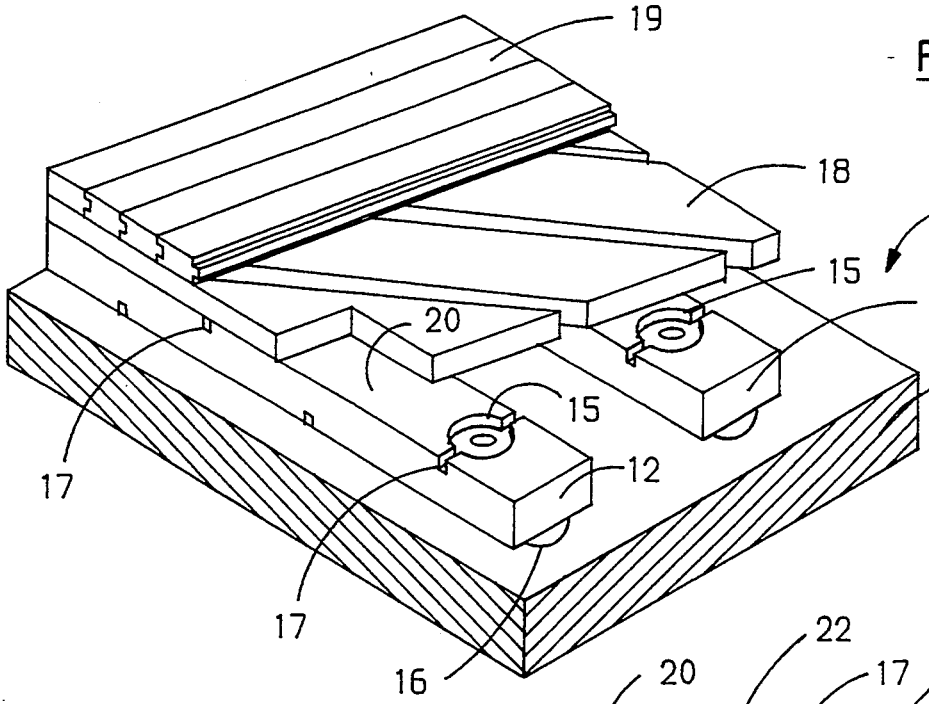
FIG. 1 is a partially sectioned pictorial view of fixed resilient sleeper athletic flooring system of this invention.

The expression "in the vicinity of."as used herein shall be read to mean "the location referred to and its near environs".

In the drawings, like numbers refer to like objects and thickness of some elements has been altered for clarity of illustration.

The term "fixed resilient sleeper" as used herein shall be read to mean "a sleeper that is substantially restrained from horizontal movement but is permitted vertical resilient movement".

Referring now to FIGS. 1 through 4 wherein a typical flooring system of this invention is illustrated.

Flooring system 10 comprises a base 11, a multiplicity of sleepers 12, having anchors 13 securing sleeper 12 to base 11, and sleeve members 14 are anchored to base 11 by anchors 13 and sleeve members 14 reside in counter bored holes 15 defined by sleepers 12, and discrete resilient pads 16 are fastened to the bottom of sleeper 12 at regular intervals, and sleeper 12 is provided with transverse saw kerfs 17 at regular intervals and placed alternately in the top and bottom of sleeper 12, and a subfloor 18 is secured to the sleeper, and a finished floor 19 of quality hardwood is secured to the subfloor.

Base 11 is typically of concrete. Subfloor 18 is typically formed from spruce-pine-fir boards or of plywood. Finished floor 19, is typically formed from hard maple flooring. Base 11, subfloor 18, and finished floor 19 are formed from substantially the same components used in prior art fixed sleeper flooring systems.

Sleepers 12 are of nominal 2"×3" boards, typically of spruce-pine-fir, having a length of at least 72" and are of lengths that are divisible by 24". Sleepers 12 are positioned parallel to each other and parallel to a wall of the venue in which the flooring system is laid, and the sleepers are spaced apart from each other a distance between 12" and 16".

Sleepers 12 have a top surface 20 and a bottom surface 21. Transverse saw kerfs 17 are cut to a depth of between $\frac{3}{8}$" and $\frac{3}{4}$", alternately in bottom surface 21 and top surface 20, on approximate 12" centers so that the distance between kerfs on the top and on the bottom surfaces is 24". The kerfs are cut, starting 12" in from an end of sleeper 12 on bottom surface 21, so that top surface 20 has at least two transverse kerfs 17, one located inward approximately 24" from each end of sleeper 12.

Counterbored holes 15 are centered on each transverse saw kerf 17 in top surface 20.

Sleeve member 14 has a generally cylindrical body 24, having a broad head end 22, and a base end 23 and sleeve member 14 defines a central bore. Body 24 of sleeve member 14 is free to move in counter bored hole 15. Anchor 13, here shown as a threaded anchor, is set in base 11 so that base end 23 of sleeve member 14 bears against base 11, and sleeper 12 is free to flex vertically during loading along the cylindrical bodies 24 of sleeve members 14, between base 11 and broad head end 22 of sleeve member 14.

Discrete resilient pads 16 are of a generally hemispheric shape with a radius of approximately $\frac{3}{4}$" and are provided with securement tabs 26 and pads 16 have a durometer in the range between 50 and 80 with 70 preferred. Pads 16 are typically custom molded for the flooring manufacturer of EPDM rubber. Pads 16 are secured to bottom surface 21 of sleeper 2 at regular intervals of approximately 12" and at the locations of transverse saw kerfs 17. Pads 16, in assembly as a part of flooring system 10 are compressed at least 1/32 inch.

Figure 3:
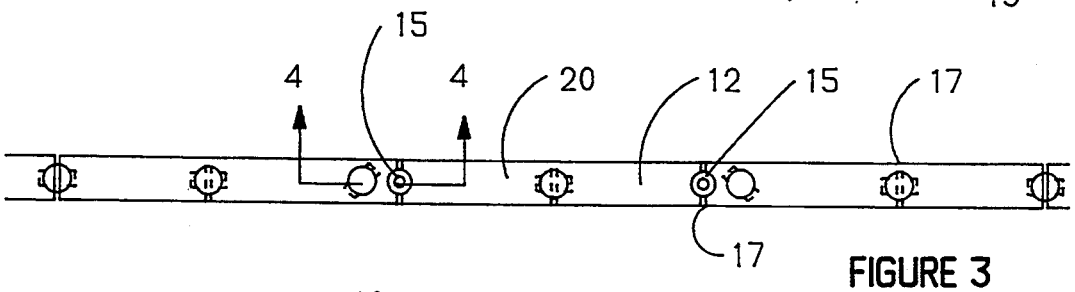
FIG. 3 is a plan view of a sleeper made according to this invention.
Figure 2:
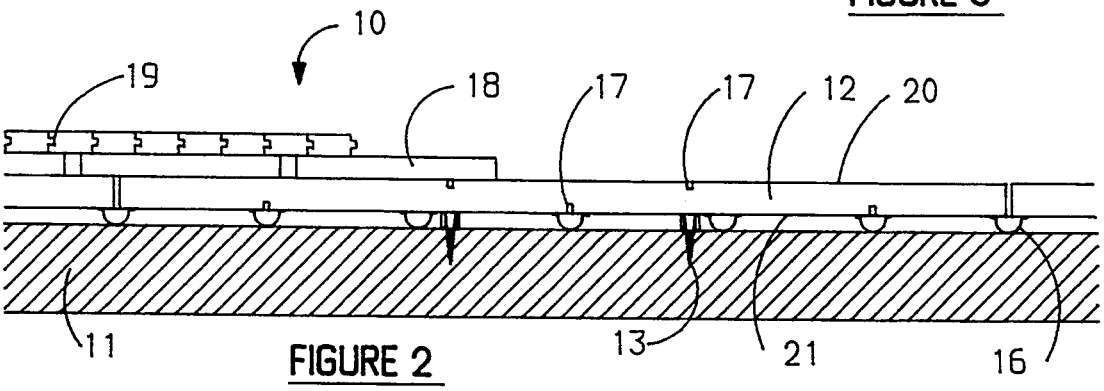
FIG. 2 is a sectioned elevational view of the flooring system of FIG. 1.

Flooring system 10 employs a multiplicity of sleepers 12 which are made up of sleeper segments that abut each other. As shown in FIGS. 2 and 3, when two sleeper segments abut, a pad 16 spans the abutting sleeper segments so that pad 16 is secured at one side to the first sleeper segment, and the pad 16 is not secured at the other side to the second sleeper segment.

Figure 4:
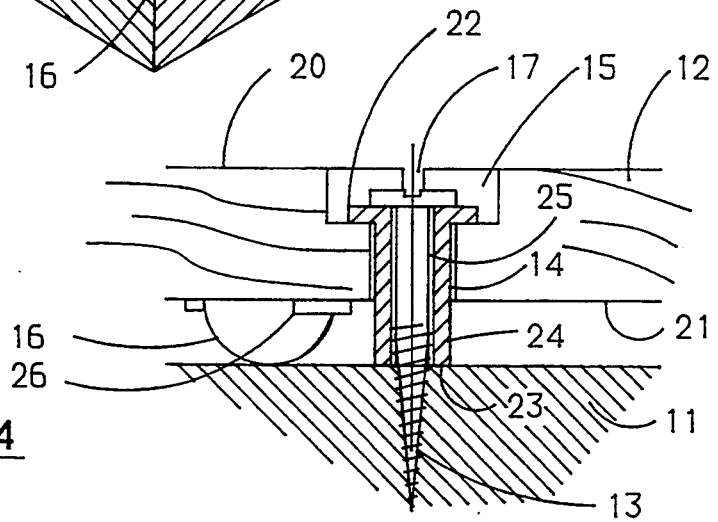
FIG. 4 is a sectioned elevational fragmentary view illustrating the sleeve member of this invention.
Figure 5:
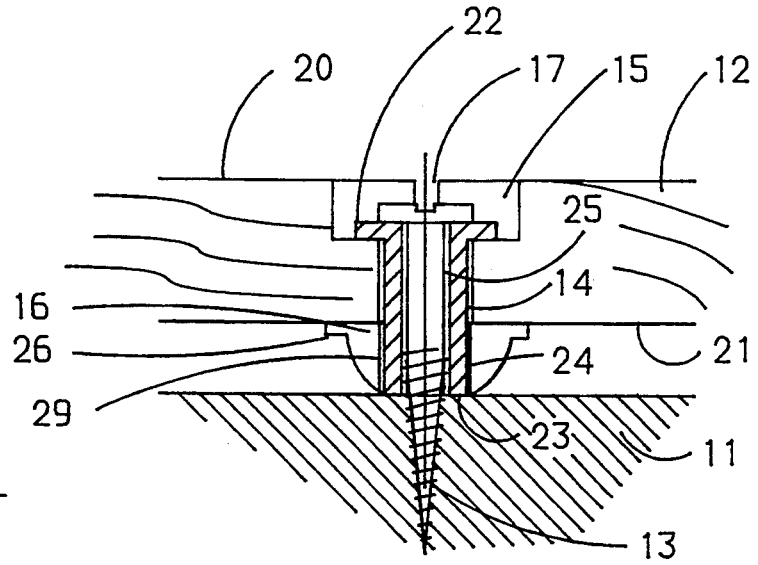

Referring now to FIG. 5 which shows sleeve 14 passing through bore 29 in pad 16. In some combinations of the elements of this invention, it is preferred that sleeve 14 pass through pad 16 as shown in FIG. 5 while in other combinations, it is preferred that pad 16 be secured to sleeper 12 at a location adjacent to sleeve 14 as shown in FIG. 4.

Subfloor 18 and finished floor 19 are made up of conventional components having a range of sizes and physical properties. In order to provide flooring system 10 with the resilient properties required to achieve DIN certification, the fixed resilient sleeper may have to be modified within the ranges disclosed above. In general, the resilient properties of flooring system 10 will change with changes in the depth of the saw kerfs 17, the resilience (durometer) of pads 16, the length of cylindrical body 24 of sleeve member 14 (changes the no load compression of pad 16), and the spacing between sleepers 12. The effects of these elements are interactive and some amount of empirical testing is ordinarily required to determine what combinations of these elements produce the most favorable results for any given set of flooring system components.

The above disclosure is an enabling disclosure that teaches the best mode of practicing the invention known to the inventor at the time of the preparation of this patent application.

However, it should be understood, that the scope of the invention should not be limited to the scope of the disclosed embodiments of the invention, but should only be limited by the scope of the appended claims and all equivalents thereto that would become apparent to one skilled in the art.

I claim;

1. A fixed resilient sleeper athletic flooring system comprising;

A) a slab base,

B) a multiplicity of floating sleepers which contain sleeper segments which abut each other anchored to the base, said sleepers being in parallel relationship with each other and parallel to a wall of a venue in which the floor is assembled, said sleepers being elongate nominal two inch by three inch boards having a top surface and a bottom surface and the top surface is provided with at least two transverse saw kerfs, each of said transverse saw kerfs positioned approximately two feet in from each end of the sleeper, and the bottom surface of the sleeper is provided with transverse saw kerfs positioned midway between each pair of saw kerfs on the top of the sleeper and also midway between the top saw kerfs and the ends of the sleeper, C) a multiplicity of individual resilient pads secured to the bottom of the sleeper at the locations of the top and bottom saw kerfs, D) a multiplicity of drilled and counter bored holes defined on the sleeper and centered on each saw kerr in the top of the sleeper, E) a multiplicity of sleeve members, which are insertable through said drilled and counter bored holes, and each sleeve member having a cylindrical body and a broad head and the sleeve member defines a central bore and the length of the cylindrical body is equal to the distance between the bottom of the counter bore hole and the base when the sleeper rests on the pads and the pads are compressed a preestablished amount;

F) each sleeve member having passing through said central bore an anchor, said anchor having a head which rests against said broad head of said sleeve member and anchors said sleeve member to said base, G) and where a first sleeper abuts a second sleeper the sleepers are bridged by an individual pad having at least two fastening tabs and one fastening tab is secured to the first sleeper and the other fastening tab is not fastened to the second sleeper, H) a subfloor secured to said sleepers by conventional means, and I) an outer floor of high quality maple secured to said subfloor by conventional means.

2. The flooring system of claim 1 wherein the two inch by three inch boards have a length that is approximately divisible by twenty-four inches and a length of at least seventy-two inches.

3. The flooring system of claim 1 wherein the saw kerfs in the two inch by three inch boards are on approximately twelve inch centers and the kerfs are positioned alternately on the bottom surface and the top surface and the first kerr in from each end of the boards is located on the bottom surface and the kerfs are at least three eighths of an inch deep and at most three fourths of an inch deep.

4. The flooring system of claim 1 wherein the resilient pads are secured to the bottom of the two inch by three inch boards and are positioned on approximately twelve inch centers at the location of the kerfs in the top and the bottom of the two inch by three inch boards and at one end of each board, so as to be attachable to a first two inch by three inch board and to support the end of a second two inch by three inch board which abuts the first two inch by three inch board.

5. The flooring system of claim 4 wherein the resilient pads are in the shape of hemispheres having a radius of approximately three fourths of an inch and a durometer of at least fifty and at most eighty, and the pads are provided with at least two attachment tabs by means of which the resilient pads may be secured to the bottom surface of the two inch by three inch boards.

6. The flooring system of claim 1 wherein the sleeve member has a head end and a base end and in assembly in a flooring system and with the anchor secured in place, the base end of the sleeve member is in contact with the base and the resilient pad at the location of the sleeve member is compressed by at least one thirty-second of an inch when measured perpendicular to the base.

7. A fixed resilient sleeper athletic flooring system comprising;

A) slab base,

B) a multiplicity of floating sleepers which contain sleeper segments which abut each other anchored to the base, said sleepers being in parallel relationship with each other and parallel to a wall of a venue in which the floor is assembled, said sleepers being assembled of elongate nominal two inch by three inch boards having a length of at least seventy-two inches and the length of the boards is divisible by twenty-four inches and the boards have a top surface and a bottom surface and the top surface is provided with at least two transverse saw kerfs, each of said transverse saw kerfs positioned approximately twenty-four inches in from each end of the sleeper, and the bottom surface of the sleeper has kerfs positioned midway between each pair of saw kerfs on the top of the sleeper and also midway between the top saw kerfs and the ends of the sleeper, and the kerfs are a minimum of three eighths of an inch deep and a maximum of three quarters of an inch deep, C) a multiplicity of individual resilient pads secured to the bottom of the sleeper at the locations of the top and bottom saw kerfs, and the pads have a hemispheric shape with a radius in the order of three quarters of an inch and the pads have a minimum durometer of sixty and a maximum durometer of eighty and the pads are provided with securement tabs, D) a multiplicity of drilled and counter bored holes defined on the sleeper and centered on each saw kerr in the top of the sleeper, E) a multiplicity of sleeve members, which are insertable into said drilled and counter bored holes, and each sleeve member having a cylindrical body and a broad head and the sleeve member defines a central bore and the length of the cylindrical body is equal to the distance between the bottom of the counter bore and the base when the sleeper rests on the pads and the pads are compressed a preestablished amount, F) each sleeve member having passing through said central bore an anchor, said anchor having a head which rests against said broad head of said sleeve member and anchors said sleeve member to said base, G) and where a first sleeper abuts a second sleeper the sleepers are bridged by an individual pad having at least two fastening tabs and one fastening tab is secured to the first sleeper and the other fastening tab is not fastened to the second sleeper, H) a subfloor secured to said sleepers by conventional means, I) an outer floor of high quality maple secured to said subfloor by conventional means, 8. A fixed resilient sleeper athletic flooring system comprising;

A) a slab base,

B) a multiplicity of fixed resilient sleepers which contain sleeper segments which abut each other anchored to the base, said sleepers being in parallel relationship with each other and parallel to a wall of a venue in which the floor is assembled, said sleepers being elongate nominal two inch by three inch boards at least seventy-two inches long and having a top surface and a bottom surface and the top surface is provided with two transverse saw kerfs, each of said transverse saw kerfs is positioned approximately twenty-four inches in from each end of the board, and the bottom surface of the sleeper is provided with transverse saw kerfs, positioned midway between the top pair of saw kerfs, and the bottom surface is further provided with saw kerfs that are midway between the top saw kerfs and the ends of the sleeper, C) a multiplicity of individual resilient pads having a radius of three quarters of an inch and the pads are provided with securement tabs, and the pads are secured to the bottom of the sleeper at the locations of the top and bottom saw kerfs, D) a multiplicity of drilled and counter bored holes defined on the sleeper and centered on each saw kerr in the top of the sleeper, E) a multiplicity of sleeve members, which are insertable into said drilled and counter bored holes, and each sleeve member having a cylindrical body and a broad head and the sleeve member defines a central bore and the length of the cylindrical body is equal to the distance between the bottom of the counter bore and the base when the sleeper rests on the pads and the pads are compressed a preestablished amount, F) each sleeve member having passing through said central bore an anchor screw, said anchor having a head which rests against said broad head of said sleeve member and anchors said sleeve member to said base, H) a subfloor secured to said sleepers by conventional means, I) an outer floor of high quality maple secured to said subfloor by conventional means.

* * * * *